US007013809B1

(12) United States Patent
Muñoz Bueno

(10) Patent No.: US 7,013,809 B1
(45) Date of Patent: Mar. 21, 2006

(54) MECANOTRONIC FUSES FOR HAND GRENADES

(75) Inventor: Leoncio Muñoz Bueno, Zaragoza (ES)

(73) Assignee: Instalaza, S.A., Zaragoza (ES)

( * ) Notice: Subject to any disclaimer, the term of this patent is extended or adjusted under 35 U.S.C. 154(b) by 0 days.

(21) Appl. No.: 10/111,443

(22) PCT Filed: Jun. 14, 2000

(86) PCT No.: PCT/ES00/00214

§ 371 (c)(1),
(2), (4) Date: Jul. 26, 2002

(87) PCT Pub. No.: WO01/31283

PCT Pub. Date: May 3, 2001

(30) Foreign Application Priority Data

Oct. 27, 1999 (ES) ..... 9902367

(51) Int. Cl.
*F42C 11/06* (2006.01)
*F42C 14/02* (2006.01)

(52) U.S. Cl. ..... 102/487; 102/207; 102/255; 102/264

(58) Field of Classification Search ..... 102/206, 102/254, 255, 264, 487
See application file for complete search history.

(56) References Cited

U.S. PATENT DOCUMENTS

| | | | | |
|---|---|---|---|---|
| 3,504,632 A | | 4/1970 | West et al. | |
| 4,145,971 A | * | 3/1979 | Graham et al. | 102/232 |
| 4,632,031 A | | 12/1986 | Jarrott et al. | |
| 5,131,328 A | * | 7/1992 | Chan | 102/229 |
| 5,693,906 A | * | 12/1997 | Van Sloun | 102/251 |
| 6,082,267 A | * | 7/2000 | Cooper | 102/487 |
| 6,142,080 A | * | 11/2000 | Ziemba | 102/267 |
| 6,272,995 B1 | * | 8/2001 | Schmidt et al. | 102/209 |
| 6,629,498 B1 | * | 10/2003 | Marquis | 102/215 |

FOREIGN PATENT DOCUMENTS

| | | | |
|---|---|---|---|
| EP | 0 369 665 A | | 5/1990 |
| EP | 0369665 | * | 5/1990 |
| EP | 0 781 975 A | | 7/1997 |
| EP | 0781975 A2 | * | 7/1997 |
| ES | 2 136 485 | | 11/1999 |
| FR | 2 483 068 A | | 11/1981 |
| FR | 2483068 | * | 11/1981 |
| FR | 2 528 967 A | | 12/1983 |

(Continued)

OTHER PUBLICATIONS 2 136 485, Es, Leoncio Munoz Bueno, Nov. 16, 1999.

*Primary Examiner*—Michael J. Carone
*Assistant Examiner*—James S. Bergin
(74) *Attorney, Agent, or Firm*—Katten Muchin Rosenman LLP

(57) ABSTRACT

The improvements are applicable to fuses provided with a container (9) inside which may move axially a slider (10) having an electrical generator (1), the activation of which provides the electrical energy required for the operation of the fuse, delivering this energy to an electronic circuit (11) which discharges on a detonator (8), which causes the detonation which through a multiplier (12) is transmitted to the explosive charge of the grenade. The novelty consists in that two electronic timers are provided which are mutually independent and which may operate under different or identical technologies, one analogue and the other digital, and in that the detonator (8) and the multiplier (12) in a resting position are unaligned, with alignment resulting from a displacement caused by a specific arrangement of the elements of the explosive chain.

4 Claims, 3 Drawing Sheets

FOREIGN PATENT DOCUMENTS

| | | | |
|---|---|---|---|
| FR | 2 559 895 A | | 8/1985 |
| FR | 2559895 | * | 9/1985 |
| FR | 2 745 080 A | | 8/1997 |
| FR | 2745080 | * | 8/1997 |
| GB | 2 195 420 A | | 4/1988 |

* cited by examiner

MECANOTRONIC FUSES FOR HAND GRENADES

DESCRIPTION

1. Object of the Invention

The present invention relates to the field of electro-mechanical fuses for hand grenades. Its objective is to make independent their different internal devices, thereby increasing the intrinsic safety of any fuse designed according to the references cited in the background.

The improvements affect on one hand, the operation of the control electric circuit and the arrangement of its elements and on the other, the arrangement of the detonator and the multiplier, and its motion from the unaligned position to the aligned position.

2. Background of the Invention

The applicant holds Spanish invention patent application number 9502554, relating to a electro-mechanical fuse for a hand grenade, which describes a fuse with mechanical activation and electronic operation whose container, which is axially coupled to the grenade body, houses in it a slider which moves axially after releasing a conventional lever safety. Said slider has the detonator fixed in a position unaligned with respect to the multiplier, so that if the detonator were to explode before arming of the fuse the expansion wave would not be transmitted to the multiplier nor to the main explosive charge, rendering the grenade useless but without any danger.

The slider holds within it a small electrical generator whose rotational motion is produced by a spiral spring which by means of a suitable transmission also causes an axial displacement of the slider. Thereby a single action generates the electrical power required to operate the fuse and initiate the detonator, and changing the latter from the unaligned position to the aligned position with the multiplier.

The detonator is powered through an electronic circuit which includes a safety switch which keeps the detonator short-circuited and a double timer.

After the lever safety is released the slider moves axially, with the detonator passing to its aligned position and electrical energy being generated. When said motion is completed the safety switch is acted on and the detonator short-circuit opened. After the first timer period for launching safety passes a first switch closes, and after a second timer for operation runs out electricity is discharged to the detonator which is initiated as a result.

SUMMARY OF THE INVENTION

The improvements proposed by the invention are designed, as previously stated, to increase the safety of the grenade, and are based on two or more independent timers and the suitable arrangement of the redundant electronic components which affect safety, and in the modification of the arrangement of the detonator and the multiplier so that they remain in the unaligned position until after a safety launching timer runs out, with the corresponding implementation of a different use for this timer.

For this purpose and more specifically, the electronic control circuit and the arrangement of the explosion chain elements are modified. Although it is described here as a joint modification, each one would provide on its own advantages over previous designs.

The improvement on the electronic control circuit consists of using timers which operate with different technologies, one analogue and the other digital, which makes them independent to external influences such as temperature or electromagnetic radiation.

Timers of the same technology, whether analogue or digital, may also be employed placed in different positions and orientations, so that they are independent to external events such as impacts and radiation. This latter solution is applicable to any redundant components, whether identical or similar. The obvious application of this solution is in fuses which require more than two timers.

The improvement of the arrangement of the elements of the explosion chain, the detonator and the multiplier, consists of placing the multiplier joined to the slider so that during the mechanical operation of the fuse the two elements move jointly, maintaining the unaligned position between said multiplier and the detonator. The union of the multiplier and slider should be such that it can be released by a small electro-explosive gas generator or a similar device.

An expansion chamber solidly joined to the slider houses on its top end an electro-explosive gas generator or a similar device, while at its opposite end it is closed by the multiplier in an arrangement such that when the electro-explosive actuator operates the gases it generates push the multiplier and separate it from the slider, placing it in an aligned position with the detonator. Initiation of the electro-explosive actuator takes place when the launching safety timer runs out.

A trip switch in the lower part of the slider maintains the detonator in a short-circuit through the multiplier, so that until the slider and the multiplier have separated the detonator cannot be initiated.

When the multiplier and detonator are in an aligned position, after the operation timer runs out, the detonator is initiated causing the detonation of the multiplier and subsequently that of the main explosive charge.

DESCRIPTION OF THE DRAWINGS

The characteristics of the present invention will be better understood in view of the accompanying drawings of a preferred embodiment of the invention, where for purposes of illustration only and in a non-limiting manner the following is shown:

FIG. 2 shows the fuse in a resting state (storage, transport, handling and up to the moment of launching). FIG. 3 shows the fuse in a launching safety state (after launching). FIG. 4 shows the fuse in an armed state (final moments before detonation). FIG. 5 shows the fuse at the time of initiation (explosion of the detonator and successively of the multiplier and the main explosive charge).

PREFERRED EMBODIMENT OF THE INVENTION

Figure 1:
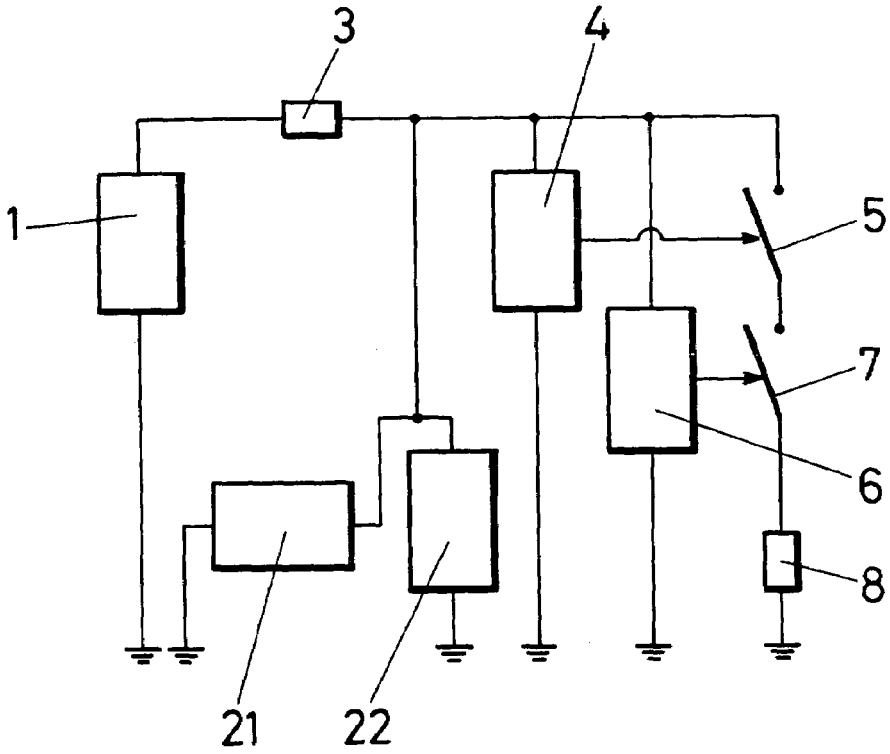
FIG. 1.—Shows a block diagram of the modified electronic circuit without applying the modification relating to the arrangement of the explosive chain elements.

Description of the improvements with reference to the figures will first be made regarding the arrangement of the elements of the explosive chain, and later regarding the electronic circuitry with block diagrams shown in FIGS. 1 and 6.

As mentioned above, the improvements of the invention are applicable to electro-mechanical fuses comprising a container (9) which houses a slider (10) within which is placed an electric generator (1), which slider (10) can move axially within container (9) when a lever (not shown) is moved, by means as those of Spanish invention Patent No. 9502554, while a generator (1) is activated by a spring coil and a transmission mechanism (also not shown, as they are identical to those of said Patent 9502554). Generator (1) produces the electrical power required for operation of the entire fuse, and delivers it to an electronic circuit (11) which at due time discharges it on detonator (8), causing a detonation which through multiplier (12) will be transmitted to the main explosive charge of the grenade (not shown).

Figure 2:
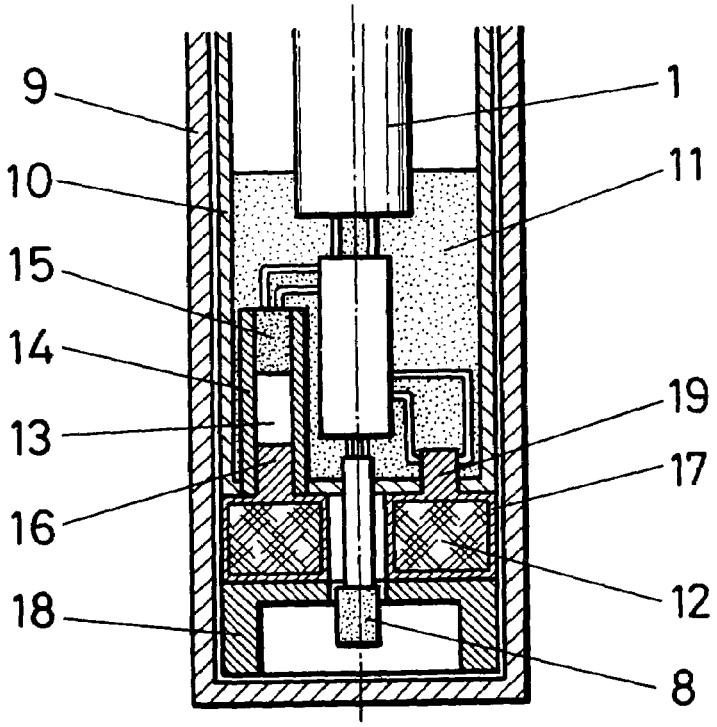
FIGS. 2 to 5.—Show a schematic representation in a sectional side view of an electro-mechanical fuse for a hand grenade constructed according to the object of the invention, showing only its lower part where the improvements are found corresponding to arrangement of the elements of the explosive chain. Specifically.

From this basic structure, the improvements of the invention are centred in that on the side of the electronics module (11) is placed an expansion chamber (13), consisting of a bushing (14) of a suitable strength on whose top end, closing it, is an electro-explosive actuator (15), while on its bottom end is inserted a piston (16) integrally connected to support (17) of multiplier (12), so that said multiplier (12) instead of being attached to container (9) as in invention patent 9502554, is carried by the slider (10) during the mechanical operation of the fuse, as shown in FIG. 2.

Figure 3:
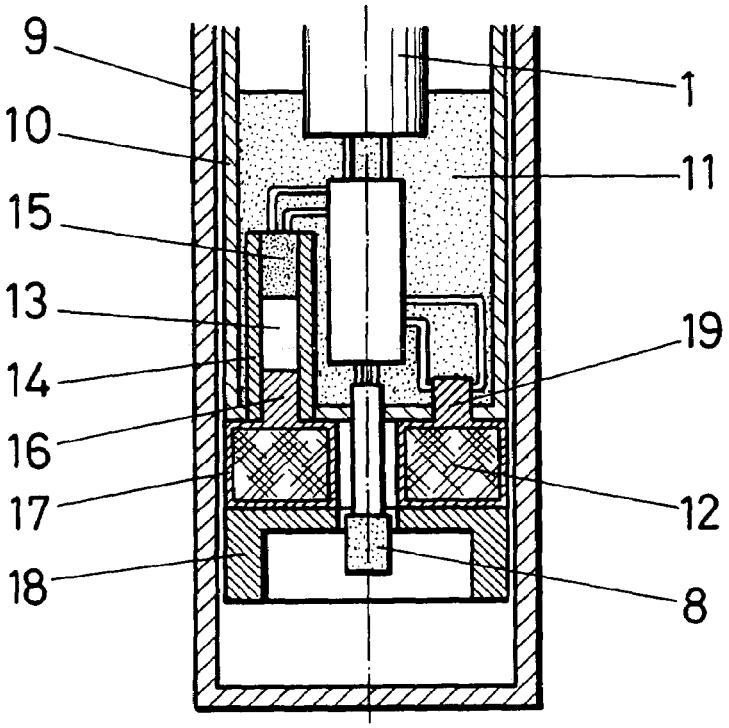

In a resting position, as shown in said FIG. 2, the detonator (8) and the multiplier (12) are unaligned by the interposition of wall (18). This situation remains throughout the launching safety time, as shown in FIG. 3.

A trip switch (19) is placed at the bottom (20) of slider (10) keeps detonator (8) short-circuited.

Figure 4:
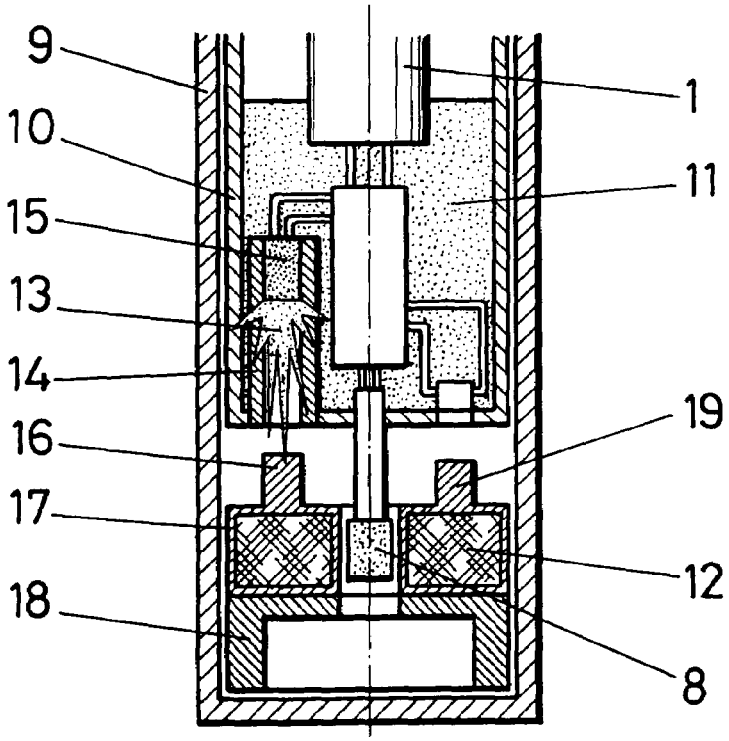
Figure 5:
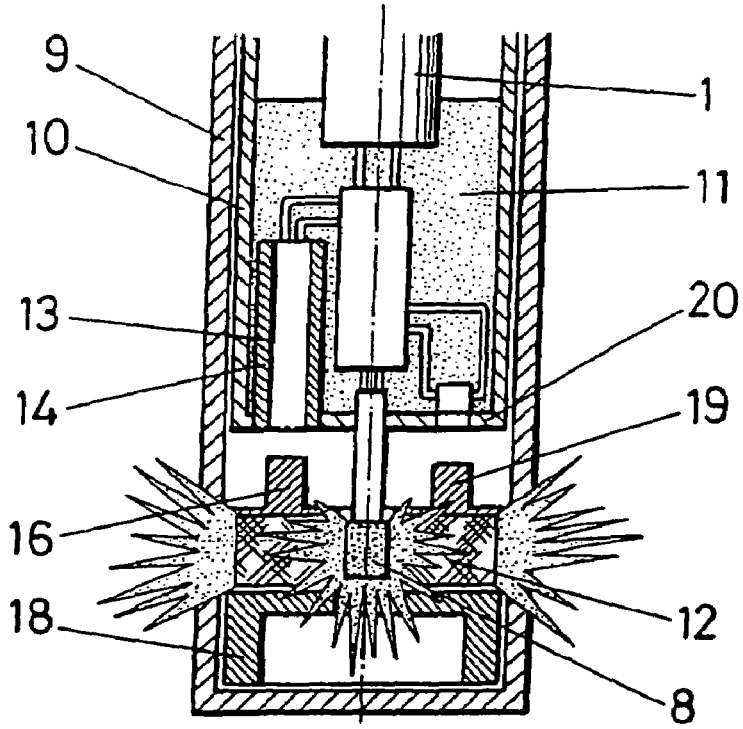
Figure 6:
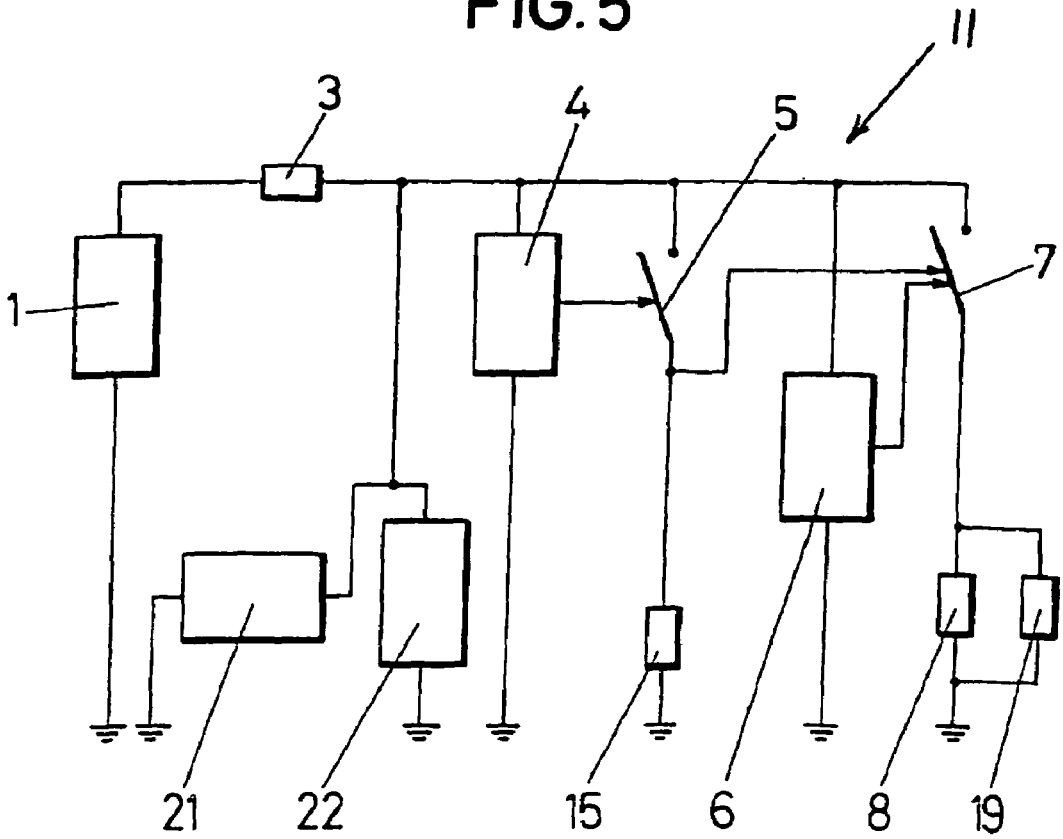
FIG. 6.—Shows a schematic block diagram of the modified electronic circuit, including the modified arrangement of the elements of the explosive chain.

Electronics module (11), as shown in FIG. 6, comprises two timers (4) and (6), the first (4) analogue and with a shorter time set, preferably 3.5 seconds, which discharges through switch (5) on electro-explosive actuator (15), which acts on piston (16) causing the motion of the multiplier support (17) and the multiplier itself (12) to the aligned situation shown in FIG. 4, finalising the arming process of the fuse.

This axial movement of multiplier (12), and more specifically of its support (17), activates the trip switch (19), opening the short-circuit of detonator (8), which is now in an aligned position with multiplier (12) and can be initiated.

At the end of the second timer (6), digital and with a somewhat longer time set, preferably four seconds, it discharges through switch (7) on detonator (8), which generates a detonation wave which through multiplier (12) and amplified by it is transmitted to the main explosive charge of the grenade.

Electrical power supply is obtained from electrical generator (1) driven by a mechanism similar to that described in patent 9502554. The power generated arrives at the electronic circuit and is stored by two redundant capacitors (21) and (22). A diode (3) prevents the energy from dissipating if there is a short-circuit external to the electronic circuit itself.

At the time of receiving power from capacitors (21) and (22), the aforementioned timers (4) and (6) are started. The first (4) is an analogue timer of the first degree which controls switch (5), jointly forming what is known as the "launching safety". The second (6) is a precision digital timer which acts on switch (7), determining the "operation time".

At the end of the launching safety time switch (5) is closed, so that after the operation time runs out and switch (7) is closed the electrical energy stored in capacitors (21) and (22) is discharged on detonator (8), in initiating the explosion of the hand grenade.

As the two timers operate under different technology, analogue and digital, they are independent from each other to external stimuli which could never be a cause of joint failure. Thus, even if an external circumstance were to cause malfunction of one of the two timers the other would still operate correctly, ensuring that the hand grenade will never explode before the end of the launching safety period.

To complete the independence from external agents capacitors (21) and (22), and any other electronic components which, due to design or safety requirements, are redundant will be placed in different positions and orientations, thereby preventing a single external stimulus causing the failure of both redundant components.

What is claimed is:

1. Improvements in electro-mechanical fuses for hand grenades, applicable to the types of fuse which comprise a container (9) which houses a movable slider (10) in which in turn is housed an electrical generator (1), which produces power required by the entire fuse, delivering it to an electronic circuit (11) which with a timed delay discharges it on a detonator (8) which detonation, through a multiplier (12) is transmitted to a main explosive charge of the grenade, the improvement fuse comprising:

at least a first and a second electronic timers, the electronic timers being mutually independent electronic timers which can be one of configured, combined and preset independently from each other, acting sequentially for the final explosion of the hand grenade to occur, and wherein inside the movable slider (10) and laterally with respect to the detonator (8) is provided an expansion chamber (13) embodied in a bushing (14), at the top end of which is placed an electro-explosive actuator (15), while on its bottom end it houses a piston (16) integrally attached to a support (17) of the multiplier (12), so that when the slider (10) moves, the support (17) moves along with it, maintaining an unaligned arrangement of the multiplier (12) and the detonator (8), while a trip switch (19) keeps the detonator (8) short-circuited, preventing its initiation.

2. Improvements in electro-mechanical fuses for hand grenades, applicable to the types of fuse which comprise a container (9) which houses a movable slider (10) in which in turn is housed an electrical generator (1), which produces power required by the entire fuse, delivering it to an electronic circuit (11) which with a timed delay discharges it on a detonator (8) which detonation, through a multiplier (12) is transmitted to a main explosive charge of the grenade, the improved fuse comprising:

at least a first and a second electronic timers, the electronic timers being mutually independent electronic timers which can be one of configured, combined and preset independently from each other, acting sequentially for the final explosion of the hand grenade to occur, and wherein the first electronic timer (4) runs a somewhat shorter time than the second electronic timer (6), the first electronic timer acting through a switch (5) on the electro-explosive actuator (15), the activation of which causes an axial displacement of a piston (16) attached to a support (17) in a multiplier (12), carrying the second electronic timer to an aligned position with respect to the detonator (8), while a trip switch (19) causes an opening of a short-circuit of the detonator (8), and after a time set by the second electronic timer (6) runs out the second electronic timer discharges through the trip switch the electrical energy meant for initiation of the detonator (8), which in its aligned position with the multiplier (12) causes the explosion of the main explosive charge.

3. An improved electro-mechanical fuse for a hand grenade, the fuse comprising:

a container;

an electro-explosive actuator disposed in the container;

a detonator for detonating a main explosive charge, both being disposed in the container;

a first electronic timer and a second electronic timer disposed in an electronics module, the first and second timer being mutually independent from each other and one being an analog type and the other being a digital type of timer;

a multiplier for amplifying the detonation of the detonator, the multiplier including a piston acted upon by the electro-explosive actuator; and wherein the first electronic timer has a shorter fuse timing that the second electronic timer, the first electronic timer upon ending the timing initiating the electro-explosive actuator to cause a displacement of the piston and the trip switch, the displacement of the trip switch opening a short-circuit of the detonator, and the second electronic timer upon ending of the timing providing electrical power to the detonator for detonating the main explosive charge.

4. An improved electro-mechanical fuse for a hand grenade, the fuse comprising:

a container;

an electro-explosive actuator disposed in the container;

a detonator for detonating a main explosive charge, both being disposed in the container;

an electronic module comprising a first electronic timer and a second electronic timer, the first and second timer being mutually independent from each other;

a multiplier for amplifying the detonation of the detonator, the multiplier including a piston acted upon by the electro-explosive actuator; and wherein the first electronic timer has a shorter fuse timing that the second electronic timer, the first electronic timer upon ending the timing initiating the electro-explosive actuator to cause a displacement of the piston and the trip switch, the displacement of the trip switch opening a short-circuit of the detonator, and the second electronic timer upon ending of the timing providing electrical power to the detonator for detonating the main explosive charge.

* * * * *